US009434562B2

(12) United States Patent
Carlson

(10) Patent No.: US 9,434,562 B2
(45) Date of Patent: Sep. 6, 2016

(54) CARD MEDIA PROCESSING SYSTEM INCLUDING TRACK ASSEMBLY AND CARS FOR CARRYING CARDS, AND RELATED METHODS

(71) Applicant: Premier Digital LLC, Harrison, OH (US)

(72) Inventor: David Carlson, Reidsville, NC (US)

(73) Assignee: Premier Digital LLC, Harrison, OH (US)

( * ) Notice: Subject to any disclaimer, the term of this patent is extended or adjusted under 35 U.S.C. 154(b) by 47 days.

(21) Appl. No.: 14/084,197

(22) Filed: Nov. 19, 2013

(65) Prior Publication Data

US 2015/0137446 A1 May 21, 2015

(51) Int. Cl.

| | |
|---|---|
| ***B65H 5/04*** | (2006.01) |
| ***B65H 3/08*** | (2006.01) |
| ***B65H 3/40*** | (2006.01) |
| ***B41J 13/12*** | (2006.01) |
| ***B65H 29/24*** | (2006.01) |

(52) U.S. Cl.

CPC ..... *B65H 5/04* (2013.01); *B41J 13/12* (2013.01); *B65H 3/0816* (2013.01); *B65H 3/40* (2013.01); *B65H 29/241* (2013.01); *B65H 2301/4212* (2013.01); *B65H 2301/447* (2013.01); *B65H 2301/4472* (2013.01); *B65H 2402/53* (2013.01); *B65H 2403/92* (2013.01); *B65H 2406/344* (2013.01); *B65H 2406/351* (2013.01); *B65H 2555/24* (2013.01); *B65H 2701/1914* (2013.01)

(58) Field of Classification Search

CPC ..... B65H 5/04; B65H 5/085; B65H 5/12; B65H 11/00; B65H 2406/361; G06K 13/07; G06K 13/073; G06K 13/077; G06K 13/10; G06K 13/12; B65G 41/02; B65G 2201/0267; B65G 2201/0297; B65G 25/02; B65G 35/08; B65G 2812/188; B61B 5/00; B61B 13/06; B41J 13/12; B41J 13/226

See application file for complete search history.

(56) References Cited

U.S. PATENT DOCUMENTS

| | | | | |
|---|---|---|---|---|
| 3,518,945 | A * | 7/1970 | Raney et al. | 104/119 |
| 3,820,455 | A | 6/1974 | Hencley et al. | |
| 3,884,370 | A | 5/1975 | Bradshaw et al. | |
| 3,921,969 | A * | 11/1975 | Hickey et al. | 271/3.14 |
| 4,375,195 | A * | 3/1983 | Tsuboi | 104/246 |
| 4,540,087 | A * | 9/1985 | Mizumoto | 198/621.1 |
| 4,825,054 | A | 4/1989 | Rust et al. | |
| 5,150,352 | A | 9/1992 | Kurihara | |
| 5,266,781 | A | 11/1993 | Warwick et al. | |
| 5,468,944 | A | 11/1995 | Urshan et al. | |

(Continued)

OTHER PUBLICATIONS

United States Patent and Trademark Office; Search Report and Written Opinion, Opinion in International Application No. PCT/US2014/066117, dated Feb. 24, 2015; 11 pages.

*Primary Examiner* — Michael McCullough

(74) *Attorney, Agent, or Firm* — Wood Herron & Evans LLP

(57) ABSTRACT

A card media processing system for treating individual cards includes a treatment assembly including a treatment device configured for sequentially treating individual cards. A car is configured to hold an individual card and to move the card to the treatment device. An endless loop track assembly is configured to support the car. The car includes a driven roller configured to engage the endless loop track assembly to move the car therealong, and the driven roller is operatively connected with a motor for causing rotation of the driven roller.

20 Claims, 7 Drawing Sheets

(56) References Cited

U.S. PATENT DOCUMENTS

| | | | |
|---|---|---|---|
| 6,142,370 | A | 11/2000 | LaManna et al. |
| 6,269,930 | B1 | 8/2001 | Dorner |
| 6,652,698 | B1 | 11/2003 | Tisserand et al. |
| 6,729,656 | B2 | 5/2004 | Kubert et al. |
| 6,902,107 | B2 | 6/2005 | Shay et al. |
| 7,210,583 | B2 | 5/2007 | Walpus et |
| 7,255,221 | B2 | 8/2007 | Ormerod et al. |
| 7,597,187 | B2 | 10/2009 | Bausenwein et al. |
| 8,096,719 | B1 | 1/2012 | Bailey et al. |
| 2001/0024228 | A1* | 9/2001 | Klinefelter et al. ..... 347/104 |
| 2004/0089706 | A1 | 5/2004 | Hill et al. |
| 2007/0289460 | A1 | 12/2007 | Tang |
| 2010/0071831 | A1 | 3/2010 | Peters et al. |

* cited by examiner

CARD MEDIA PROCESSING SYSTEM INCLUDING TRACK ASSEMBLY AND CARS FOR CARRYING CARDS, AND RELATED METHODS

TECHNICAL FIELD

The present invention generally relates to processing card media, and more particularly to systems for performing treatment operations on card media, such as plastic cards.

BACKGROUND

Card media, such as plastic credit cards, bank cards, loyalty cards, gift cards, identification cards, and the like, are in broad general use. A typical consumer might have a dozen or more such cards, for example. Fortunately for consumers, their cards are usually distinguishable based on the unique appearance of each, which is typically related to the printing or logos contained on the cards.

As part of their manufacture, and before they reach consumers, these types of cards typically receive various processing treatments, such as printing and magnetic stripe encoding. Printing can provide a desired appearance to a card. For example, a restaurant or retailer can have their logo printed onto plastic cards, which can then be sold to consumers as gift cards. The consumer, in turn, will have a gift card bearing the logo and will be visually reminded of the source of the card.

Known processing equipment for treating card media includes so-called straight-line processing systems. These systems typically use a conveyance device (such as vacuum belt systems, chain systems, belt and roller systems, or combinations of the same) for moving cards between treatment devices along an essentially straight-line path. Treatment devices, such as printers and magnetic stripe encoders, are sensitive to the position of a plastic card on a conveyance device, and improperly positioned cards can result in treatment problems or inconsistencies. Known processing equipment, especially known conveyance devices, provides only limited control over card positioning. This limited control often results in unsatisfactory card treatment, however.

There is a need, therefore, for card processing systems that address one or more of the drawbacks discussed above.

SUMMARY

Embodiments of the present invention are directed to card media processing systems, and methods of using the same for treating cards.

According to an embodiment of the invention, a card media processing system is provided for treating individual cards. The card media processing system includes a treatment assembly including a treatment device configured for sequentially treating individual cards, and a car configured to hold an individual card and to move the card to the treatment device. The card media processing system further includes an endless loop track assembly configured to support the car. The car includes a driven roller configured to engage the endless loop track assembly to move the car therealong, and the driven roller is operatively connected with a motor for causing rotation of the driven roller.

According to another embodiment of the invention, a card media processing system is provided for treating individual cards. The card media processing system includes a treatment assembly including a plurality of treatment devices configured for sequentially treating individual cards, and a plurality of cars. Each car is configured to hold an individual card and to move the card to and between the plurality of treatment devices. The card media processing system further includes an endless loop track assembly configured to support the plurality of cars, and a card loading and unloading assembly configured to deliver a card to a car and to remove a card from a car. Each car is configured to be controlled independently of the other cars, and includes a driven roller configured to engage the endless loop track assembly to move the car therealong. Each driven roller is operatively connected with a servomotor for causing rotation of the driven roller.

According to another embodiment of the invention, a method is provided for treating card media. The method includes delivering an individual card onto a car, and operating a motor to move the car along an endless loop track assembly toward a treatment device. The method further includes performing a treatment on the card with the treatment device, and operating the motor to move the card further along the endless loop track assembly away from the treatment device. The method further includes removing the card from the car.

Various additional features and advantages of the invention will become more apparent to those of ordinary skill in the art upon review of the following detailed description of the illustrative embodiments taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE DRAWINGS

Figure 1:
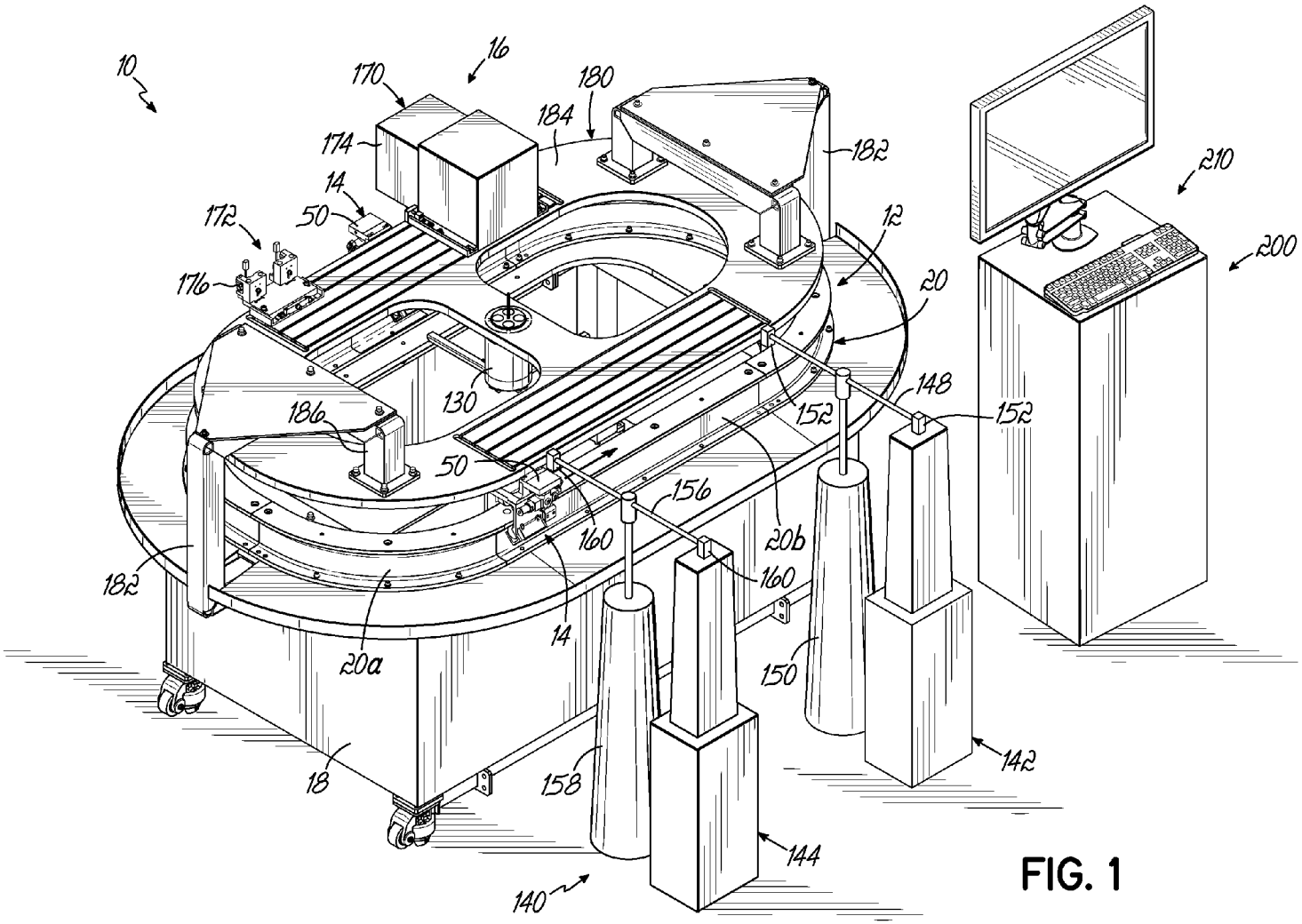
FIG. 1 is an isometric view showing a card media processing system constructed according to an embodiment of the invention.
Figure 2:
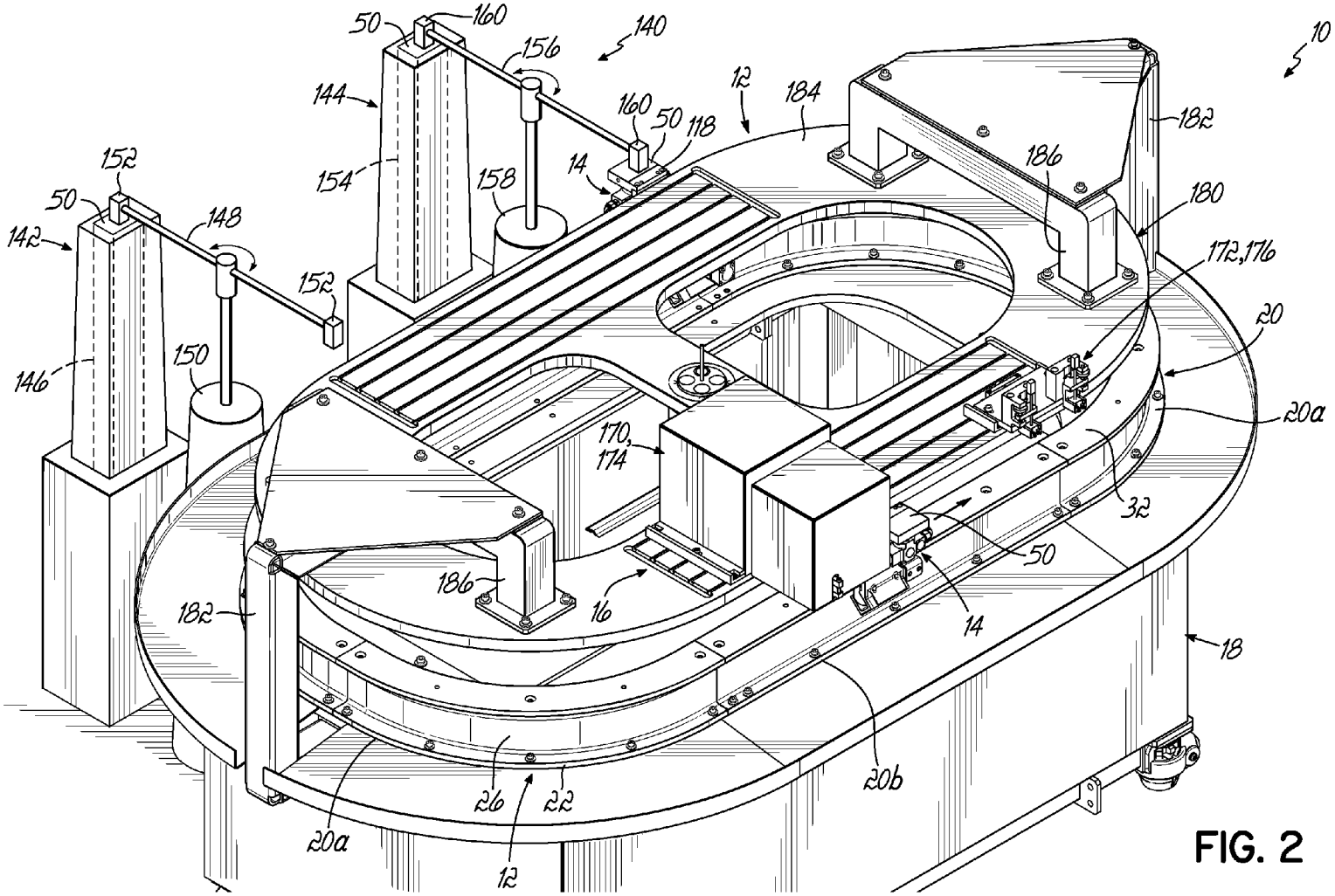
FIG. 2 is another isometric view showing features of the card media processing system of FIG. 1.

Referring to the figures and beginning with FIGS. 1 and 2, a card media processing system 10 is shown and generally includes a track assembly 12 that supports one or more cars 14, and a treatment assembly 16 for treating cards that are carried by the cars 14. In the embodiment shown, the track assembly 12 is supported by a support member 18. As will be evident from the following description, the processing system 10 is useful for personalizing or treating individual card media or cards, such as plastic credit cards, bank cards, loyalty cards, gift cards, identification cards, and the like.

The track assembly 12 includes a plurality of rail sections 20 configured to support the cars 14, and the rail sections 20 are arranged so as to form an endless loop shape. For example, and as shown in the figures, the rail sections 20 include generally curved sections 20*a* and generally straight sections 20*b* arranged to form a generally obround or elliptical shape. Other endless loop shapes are also possible, such as ovals, rectangles, circles, irregular loop shapes, and others. Advantageously, by using a plurality of rail sections 20, the size and shape of the track assembly 12 is scalable and can be adjusted, as appropriate. In addition, while a plurality of rail sections 20 are shown, a similarly shaped monolithic rail member could also be used. As will be discussed further below, the cars 14 travel on the rail sections 20 and move cards between various devices of the treatment assembly 16 as part of a treatment operation.

Figure 3:
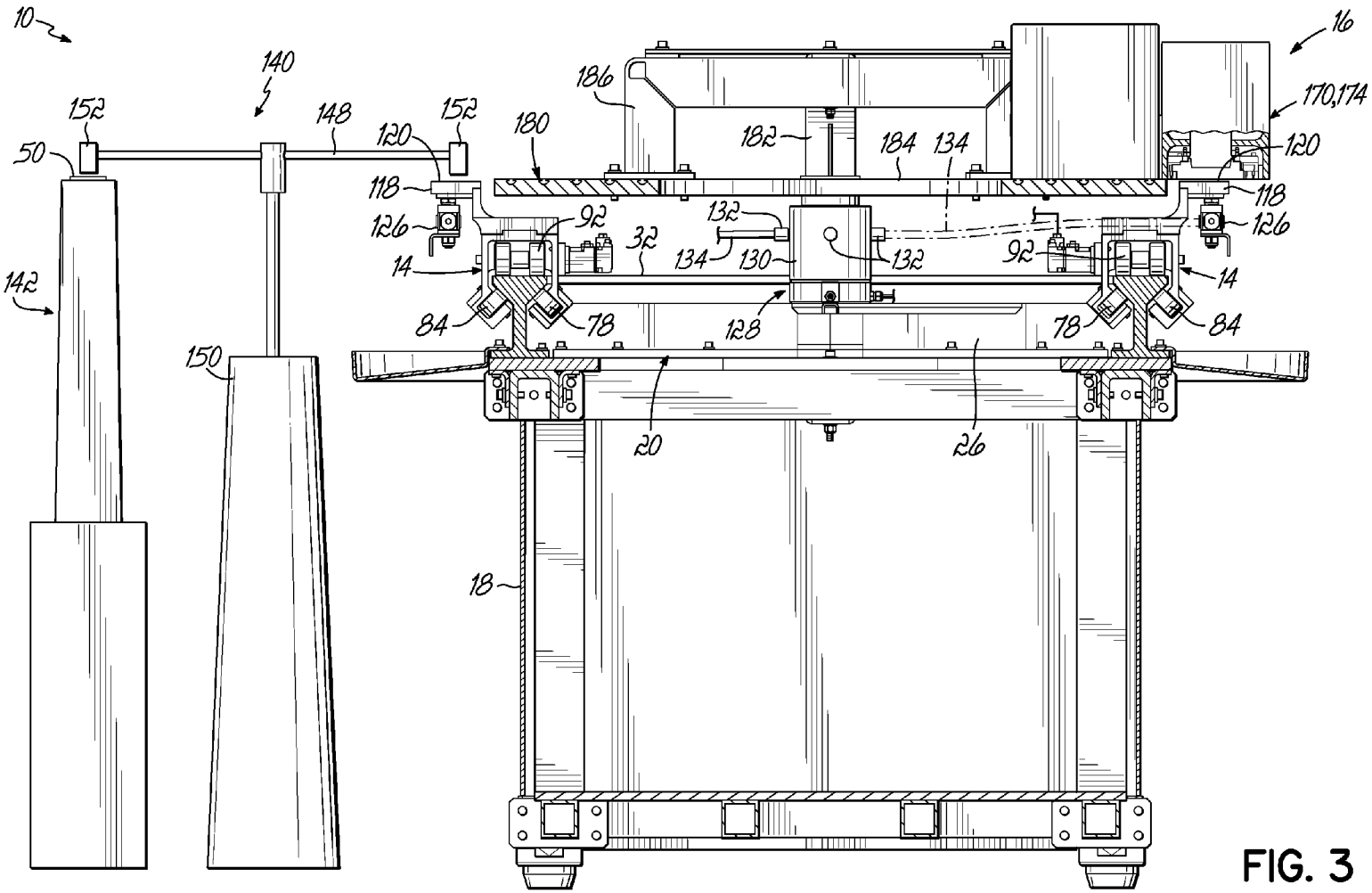
FIG. 3 is a partial sectional view showing additional features of the card media processing system of FIG. 1.
Figure 4:
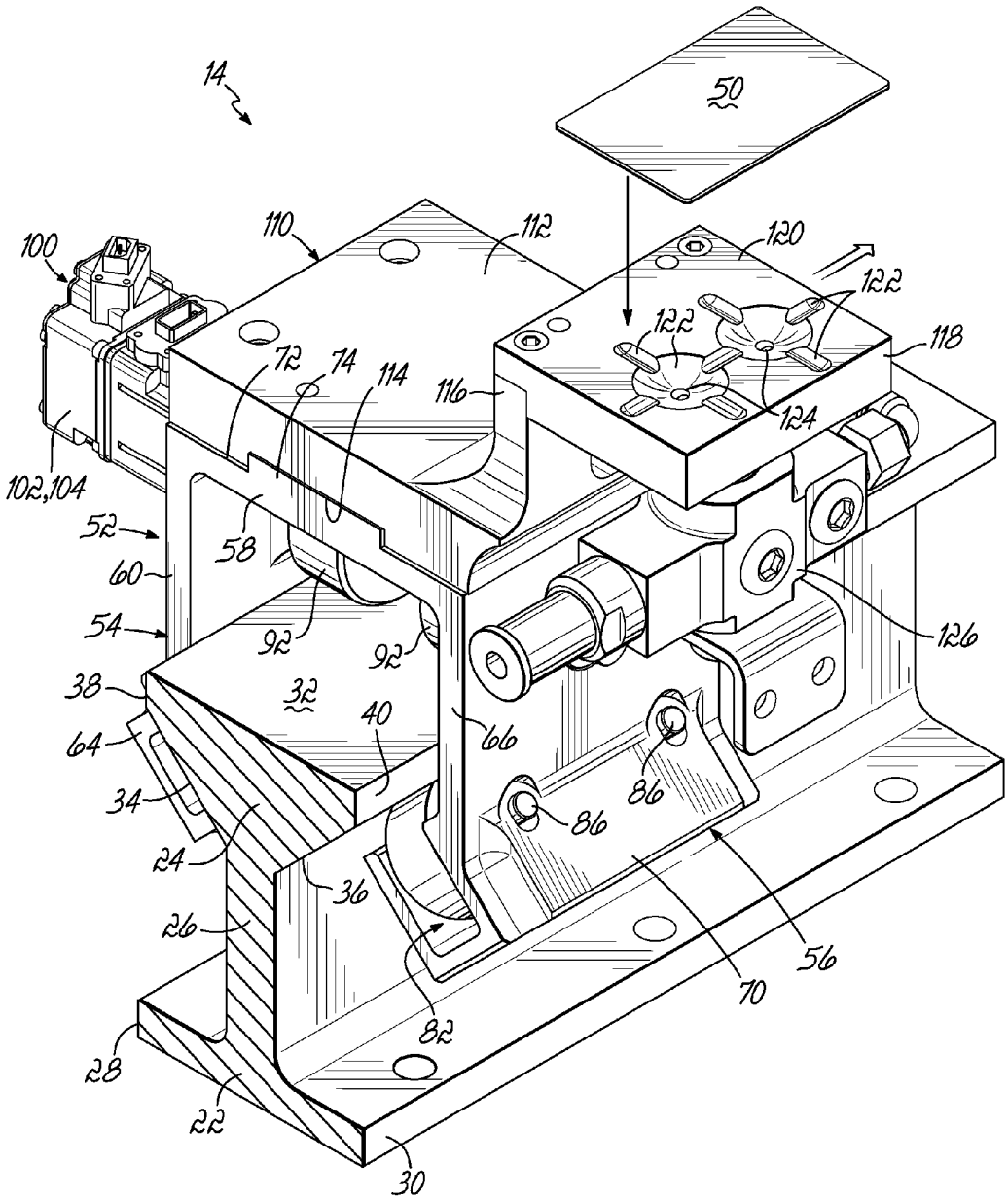
FIG. 4 is a partial sectional isometric view showing a card carrying car on a rail section of a track assembly of the card media processing system of FIG. 1.
Figure 5:
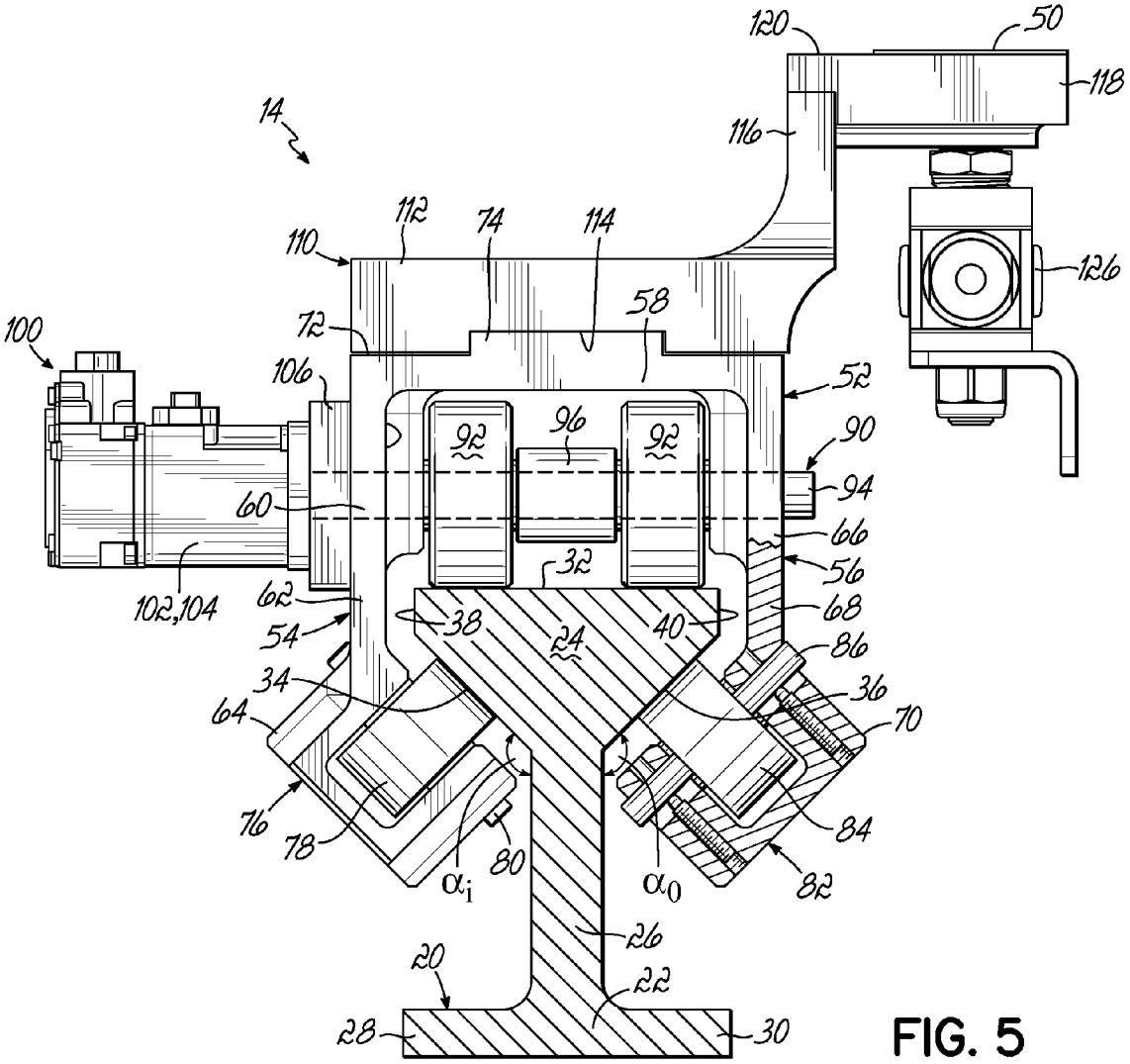
FIG. 5 is a partial cross-sectional view showing the car and rail section of FIG. 4.

With reference to FIGS. 3-5, and especially FIG. 5, the rail sections 20 (including the curved sections 20*a* and the straight sections 20*b*) have a generally I-shaped profile that includes a foot 22, a head 24, and a web 26 extending between the foot 22 and the head 24. The foot 22 includes an inner foot section 28 and an outer foot section 30, with the inner foot section 28 on the inner region of the obround shaped track assembly 12 and the outer foot section 30 on the outer region of the obround shaped track assembly 12. The foot 22, including its inner foot section 28 and outer foot section 30 extends generally perpendicular to the web 26, which extends upwardly from the foot 22 and connects with the head 24.

The head 24 generally includes an upper rail surface 32, an inner rail surface 34, and an outer rail surface 36. The rail surfaces 32, 34, 36 are configured to be engaged by rollers on the cars 14, as will be discussed further below. An inner wall portion 38 depends downwardly from the upper rail surface 32 and connects with the inner rail surface 34. As shown, the inner wall portion 38 is generally perpendicular with the upper rail surface 32. The inner rail surface 34 extends downwardly from the inner wall portion 38 and toward the web 26 so as to connect with the web 26 at a position between the foot 22 and the upper rail surface 32 so as to define an inner angle $\alpha_i$.

In addition, an outer wall portion 40 depends downwardly from the upper rail surface 32 and connects with the outer rail surface 36. Like the inner wall portion 38, the outer wall portion 40 is generally perpendicular with the upper rail surface 32. The outer rail surface 36 extends downwardly from the outer wall portion 40 toward the web 26 so as to connect with the web 26 at a position between the foot 22 and the upper rail surface 32 so as to define an outer angle $\alpha_o$.

Each car 14 is configured to receive and hold an individual card 50, such as a plastic card, (FIGS. 4 and 5), and to travel on the rail sections 20 to transport the card 50 between various devices of the treatment assembly 16 as part of a treatment operation. Because the cars 14 are generally similar, a description of one car 14 will be provided, it being appreciated that the same description applies to the other cars 14. A car 14 generally includes a chassis 52 having an inner fork 54, an outer fork 56, and a span member 58 connecting the forks 54, 56.

The inner fork 54 includes an inner arm section 60, which tapers at 62, and an inner guide roller section 64 coupled with the inner arm section 60. The inner guide roller section 64 is generally opposite the span member 58. Similarly, the outer fork 56 includes an outer arm section 66, which tapers at 68, and an outer guide roller section 70. The outer guide roller section 70 is generally opposite the span member 58.

The span member 58 connects the inner and outer arm sections 60, 66 and generally provides a mounting platform 72 that includes an upwardly extending locating projection 74. A card 50 is supported above the mounting platform 72, as will be described further below.

The inner guide roller section 64 supports an inner guide roller assembly 76 that includes two guide rollers 78 (only one shown), each rotatable about an axle 80. The guide rollers 78 rollingly engage with the inner rail surface 34 of the rail section 20, as shown. The axle 80 extends generally parallel with the inner rail surface 34.

Similarly, the outer guide roller section 70 supports an outer guide roller assembly 82 that includes two guide rollers 84 (only one shown), each rotatable about an axle 86. The guide rollers 84 rollingly engage with the outer rail surface 36 of the rail section 20, as shown. The axle 86 extends generally parallel with the outer rail surface 36.

While the inner and outer guide roller assemblies 76, 82 each include two guide rollers, different numbers of guide rollers could be used, including a single guide roller for each guide roller assembly 76, 82.

The inner and outer forks 54, 56 support a driven roller assembly 90 which generally includes driven rollers 92 on a driven axle 94. The driven rollers 92 are separated by a bushing 96 and are rotatably fixed to the driven axle 94, such that rotation of the driven axle 94 causes rotation of the driven rollers 92. The driven rollers 92 rollingly engage with the upper rail surface 32 of the rail section 20, as shown. As shown, the driven axle 94 extends generally parallel with the upper rail surface 32.

The driven roller assembly 90 is operatively connected with a motor assembly 100. For example, in the embodiment shown, the driven axle 94 extends through the inner arm section 60 and is connected with a motor 102 inside a motor housing 104. The motor assembly 100 is connected with the chassis 52 through a mounting plate 106 that is attached to the inner arm section 60. Actuation of the motor 102 causes the driven axle 94 to rotate.

Thus, when the motor 102 is actuated so as to rotate the driven axle 94, the driven rollers 92 are also rotated so as to engage and roll along the upper rail surface 32, thereby moving the car 14 on the track assembly 12. At the same time, the guide rollers 78, 84 of the inner and outer guide roller assemblies 76, 82 engage and roll along the inner and outer rail surfaces 34, 36, respectively, helping to guide the car 14 along the track assembly 12.

In some embodiments, the motor 102 includes a servomotor, such as any of the R88 models offered by the OMRON Corporation. A servomotor can include a motor and a position detection component, and can provide precise control of the operation of servomotor, as is generally known. Because the motor 102 is connected with the driven axle 94, precise operation of the motor 102 allows the driven axle 94 to be precisely controlled. By precisely controlling the driven axle 94, the position and movement of a car 14 on the track assembly 12 can also be precisely controlled.

Each car 14 also includes a card mount 110 configured to receive and hold a card 50, as shown in FIGS. 4 and 5. In the embodiment shown, the card mount 110 includes a mounting portion 112 coupled with the chassis 52. In particular, the mounting portion 112 includes a locating recess 114 that receives the locating projection 74 of the mounting platform 72 of the span member 58. The card mount 110 also includes an upstanding wing 116 extending from the mounting portion 112. The card mount 110 also includes a card holding platform 118 supported by the upstanding wing. The platform 118 includes a surface 120 configured for receiving the card 50. A series of channels 122 are formed in the platform 118 extending down from the surface 120, and are configured to serve as a vacuum chuck for holding the card 50 on the surface 120. Thereby, the card 50 can be held securely on the platform 118 as the car 14 moves along the track assembly 12. In the embodiment shown, the card 50 is held on the car 14 in a generally horizontal orientation.

In particular, the channels 122 are in fluid communication with one or more flow ports 124 in the platform 118. The flow port(s) 124, in turn, is in fluid communication with a pneumatic connector 126, which in the embodiment shown, is carried by the platform 118. The pneumatic connector 126 is configured to be coupled with a source 128 of vacuum pressure (FIG. 3).

As shown in FIG. 3, the source 128 of vacuum pressure is associated with a rotatable hub 130 situated in a generally central location of the obround shaped track assembly 12. The hub 130 includes a plurality of pneumatic connectors 132. A pneumatic line 134 connects one of the pneumatic connectors 132 of the source 128 of vacuum pressure with the pneumatic connector 126 on the car 14. The source 128 of vacuum pressure thereby provides vacuum pressure to the pneumatic connector 126 through the pneumatic line 134. The vacuum pressure is thereby transmitted through the pneumatic connector 126 to the flow port(s) 124 and the channels 122 to provide suction action for holding the card 50 on the surface 120. Also, because the hub 130 is rotatable, as a car 14 moves around the track assembly 12, the hub 130 rotates so as to maintain the vacuum pressure connection between the source 128 of vacuum pressure and the car 14.

In some embodiments, the card holding platform 118, including the surface 120, is smaller in its length and width dimensions than the card 50 held thereon. Thereby, edge-to-edge treatments can be applied to the card 50 without applying any of the treatment to the card holding platform 118 or the surface 120.

It will be appreciated that any number of cars 14 can be used in the card media processing system 10, depending on various factors such as the size of the track assembly 12, the number or contents of the treatment assembly 16, the desired throughput of cards 50, and others.

The card media processing system 10 also includes a card loading and unloading assembly 140, as illustrated in FIGS. 1 and 2. In the embodiment shown, this includes a loading device 142 and an unloading device 144.

The loading device 142 is configured to retrieve a card 50 from a supply 146 of cards and to deliver the card 50 to a car 14 as part of a treatment operation. In the embodiment shown, the supply 146 of cards is arranged in a stack. In particular, the loading device 142 is configured to deliver a card 50 from the supply 146 to the surface 120 of the card holding platform 118 of a car 14. The loading device 142 includes a delivery arm 148 rotatably coupled with a base 150. The delivery arm 148 includes one or more card holding hands 152 configured to retrieve, hold, and release a card 50. In the embodiment shown, the delivery arm 148 has two card holding hands 152 at opposite ends thereof. The loading device 142 may use suction action to retrieve and hold a card 50, for example.

Thus, a card holding hand 152 can be used to retrieve a card 50 from the supply 146. The card holding hand 152 holds the card 50, and the delivery arm 148 is rotated with respect to the base 150 so that the card holding hand 152 is positioned proximate the surface 120 of a car 14 on the track assembly 12. The card holding hand 152 then releases the card 50, positioning it on the surface 120 of the car 14.

At the same time that one of the card holding hands 152 is delivering a card 50 to a car 14, the other of the card holding hands 152 can be used to retrieve the next card 50 from the supply 146. Thereby, the actions of retrieving a card 50 and delivering a card 50 can be performed generally simultaneously, and the next card 50 to be delivered is already held by a card holding hand 152.

The unloading device 144 is substantially similar to the loading device 142 in construction and operation, but is used to retrieve a card 50 from a car 14 and to deliver the card 50 to an inventory 154 of cards. The unloading device 144 includes a delivery arm 156 rotatably coupled with a base 158. The delivery arm 156 includes one or more card holding hands 160 configured to retrieve, hold, and release a card 50. In the embodiment shown, the delivery arm 156 has two card holding hands 160 at opposite ends thereof. The unloading device 144 may use suction action to retrieve and hold a card 50, for example.

A card holding hand 160 can be used to retrieve a card 50 from a car 14. The card holding hand 160 holds the card 50, and the delivery arm 156 is rotated with respect to the base 158 so that the card holding hand 160 is positioned proximate the inventory 154. The card holding hand 160 then releases the card 50, positioning it on the inventory 154.

At the same time that one of the card holding hands 160 is delivering a card 50 to the inventory 154, the other of the card holding hands 160 can be used to retrieve the next card 50 from the next car 14. Thereby, the actions of delivering a card 50 and retrieving a card 50 can be performed generally simultaneously, and the next card 50 to be delivered is already held by a card holding hand 152.

While the loading and unloading assembly 140 shown includes separate loading and unloading devices 142, 144, other configurations are possible. For example, a loading and unloading assembly could use a single device for performing the functions of the loading and unloading devices 142, 144 discussed above.

As mentioned above, the card media processing system 10 also includes a treatment assembly 16 for treating the cards 50 that are carried by the cars 14 as part of a treatment operation for each card 50. Particularly, the treatment assembly 16 is configured for sequentially treating individual cards 50 carried by the cars 14. In the embodiment shown, and as shown in FIGS. 1 and 2, the treatment assembly 16 includes a first treatment device 170 and a second treatment device 172. The first treatment device 170 includes a printer 174, such as an inkjet style printer, for printing on a card 50. The second treatment device 172 includes a magnetic stripe encoding device 176. Advantageously, the treatment devices 170, 172 of the treatment assembly 16 are arranged in a manner so that cars 14 traveling on the track assembly 12 encounter the treatment devices 170, 172 in a desired or appropriate order.

Figure 6:
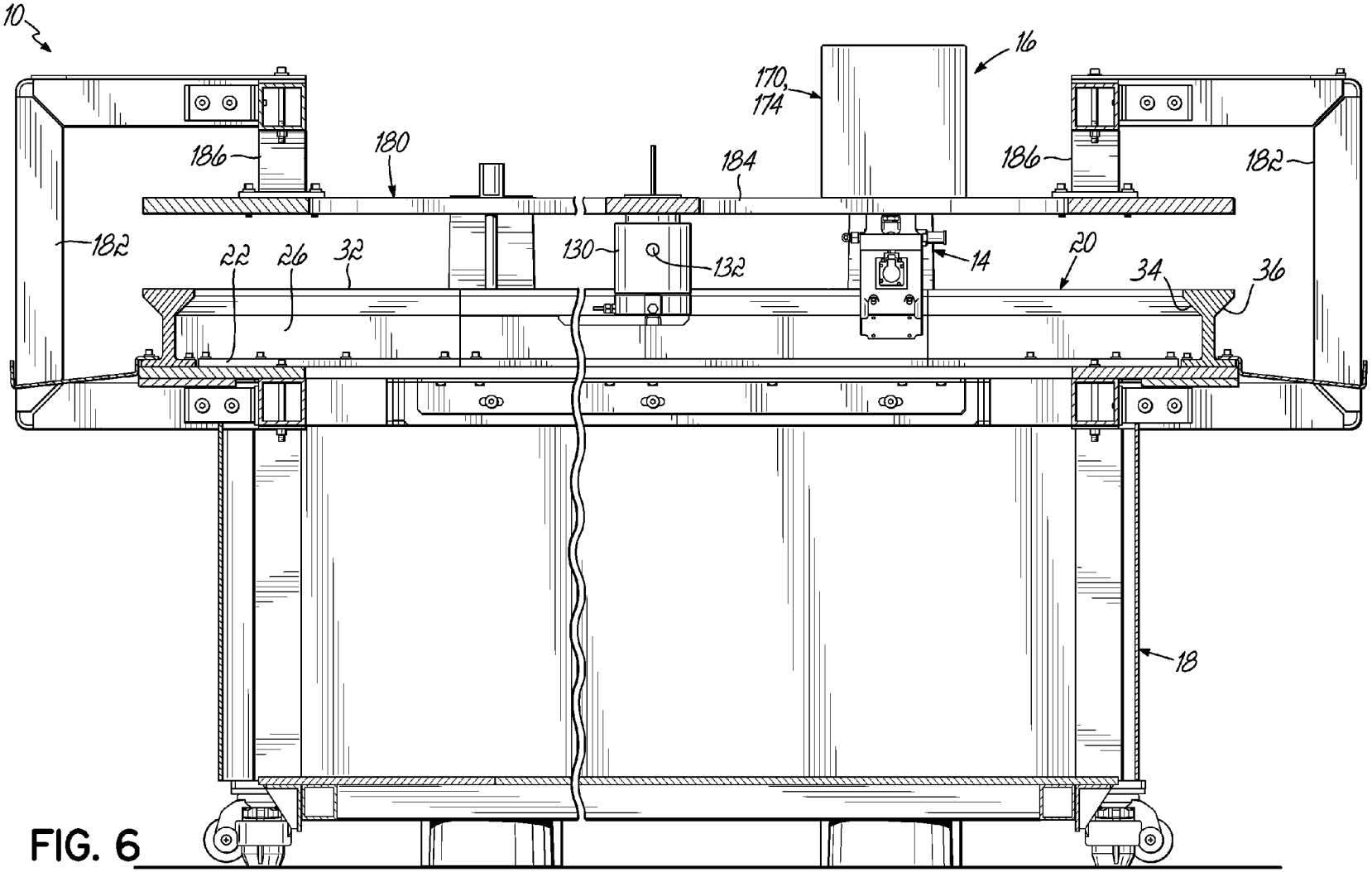
FIG. 6 is a further partial sectional view showing additional features of the card media processing system of FIG. 1, including a platform assembly for supporting treatment devices.

In the embodiment shown, the treatment devices 170, 172 of the treatment assembly 16 are supported by a platform assembly 180 (see FIG. 6). The platform assembly 180 is supported generally above the track assembly 12. As shown, connecting arms 182 extend from the support member 18 beneath the track assembly 12 and support a platform 184. More particularly, the connecting arms 182 extend outwardly from the support member 18, then upwardly in order to provide clearance for movement of the cars 14 on the track assembly 12. Mounting brackets 186 connect the platform 184 with the connecting arms 182.

The platform 184 supports the treatment devices 170, 172 of the treatment assembly 16 above the track assembly 12. In particular, the platform 184 is configured to allow the treatment devices 170, 172 to be appropriately positioned relative to a card 50 carried by a car 14 as the car 14 moves along the track assembly 12. While the platform 184 is shown being connected to the support member 18, other configurations for supporting treatment devices are also possible, such as those that are not connected to the support member 18.

It will be appreciated that the treatment devices 170, 172 are merely exemplary, and that other appropriate treatment devices for treating a card could be used in place of, or in addition to, those shown in the figures in association with the card media processing system 10. For example, an RFID device could be used to print and/or encode an RFID element on a card 50. Also, various devices could be included in the treatment assembly 16 to prepare the cards 50 for subsequent steps in a treatment operation, such as cleaner devices and surface preparation devices. In addition, various devices could be included in the treatment assembly 16 for treating cards 50 after they have undergone part of a treatment operation, such as curing devices and devices for applying sealants or clear coats to the cards.

Further, the treatment assembly 16 could include various devices for assessing the performance of treatment devices, such as a camera system for monitoring aspects of treatment operations performed on the cards 50. Moreover, the treatment assembly 16 could include multiple treatment devices of the same type. For example, multiple magnetic strip encoding devices could be used in a treatment assembly 16 for cards 50 having more than one magnetic stripe.

While the cards 50 shown in the figures are rectangular credit-card sized plastic media (CR-80, 3.375"×2.125"), it will be appreciated that the card media processing system 10, including its cars 14, treatment assembly 16, and other components can be configured to work with different card media sizes and formats, as well. For example, the card media processing system 10 can be used with paper media, clear media, oddly shaped media, edible media, and others.

The card media processing system 10 is used to process cards 50 as part of a treatment operation as follows.

First, the loading and unloading assembly 140 provides a card 50 to a car 14 on the track assembly 12. In particular, the loading device 142 retrieves a card 50 from the supply 146 of cards and operates to position the card 50 on the card mount 110 of the car 14. The card holding hand 152 retrieves a card 50 from the supply 146, and the delivery arm 148 is moved so the card holding hand 152 is positioned proximate the car 14 on the track assembly 12. The card holding hand 152 releases the card 50, and the card 50 is placed on the surface 120 of the card holding platform 118 of the card mount 110. In some embodiments, the card 50 is positioned on the car 14 when the car 14 is stopped on the track assembly 12. In other embodiments, the card 50 is positioned on the car 14 as the car 14 moves on the track assembly 12. Once a card 50 is placed on the car 14, it is held on the surface 120 by the suction action provided by the vacuum pressure in the channels 122.

The car 14 having the card 50 moves on the track assembly 12 toward the treatment assembly 16. In particular, the car 14 is moved by actuation of the motor 102. Actuation of the motor 102 rotates the driven axle 94 and the driven rollers 92 of the car 14. The driven rollers 92 engage the upper rail surface 32 of the rail sections 20 of the track assembly 12, thereby moving the car 14. The guide rollers 78, 84 engage the inner and outer rail surfaces 34, 36 and guide the car 14 along the track assembly 12.

The car 14 is moved toward the first treatment device 170, which performs a first treatment on the card 50 carried by the car 14. Advantageously, the speed of the car 14 on the track assembly 12 is adjusted to accommodate the first treatment. In some embodiments, the car 14 comes to a stop on the track assembly 12 adjacent the first treatment device 170 for the first treatment. In other embodiments, the car 14 is moving on the track assembly 12 for the first treatment.

After the first treatment is completed, the car 14 moves further on the track assembly 12 toward the second treatment device 172. The second treatment device 172 then performs a second treatment on the card 50. Advantageously, the speed of the car 14 on the track assembly 12 is adjusted to accommodate the second treatment. In some embodiments, the car 14 comes to a stop on the track assembly 12 adjacent the second treatment device 172 for the second treatment. In other embodiments, the car 14 is moving on the track assembly 12 for the second treatment.

After the second treatment is completed, the car 14 moves further on the track assembly 12 toward the loading and unloading assembly 140, which removes the card 50 from the car 14. In particular, the unloading device 144 retrieves the card 50 that has just undergone the first and second treatments from the car 14. The card holding hand 160 retrieves the card 50 from the surface 120 of the card holding platform 118 on the car 14. The delivery arm 156 is moved so the card holding hand 160 is positioned proximate the inventory 154. The card holding hand 160 releases the card 50 onto the inventory 154. In some embodiments, the card 50 is retrieved from the car 14 when the car 14 is stopped on the track assembly 12. In other embodiments, the card 50 is retrieved from the car 14 as the car 14 moves on the track assembly 12. Also, in some embodiments the suction action provided by the vacuum pressure in the channels 122 can be interrupted to facilitate the card 50 being retrieved from the car 14.

After the unloading device 144 has retrieved the card 50 from the car 14, the car 14 is ready to receive another card 50, and the above-described process may be repeated.

Advantageously, multiple cars 14 may operate on the track assembly 12 at the same time in order to increase the throughput of cards 50 treated by the processing system 10 in a given amount of time. For example, as one car 14 is receiving a card 50, another car 14 can be positioned so that a card 50 thereon is receiving treatments from the treatment assembly 16. Each car 14 may be independently controlled and operated.

Also advantageously, the speed of each car 14 may be adjusted as it moves on the track assembly 12. For example, a car 14 may be operated to move rapidly at some intervals and slowly or stopped at other intervals. For example, after a car 14 receives a card 50 from the loading device 142, the car 14 can accelerate and move rapidly toward the first treatment device 170. The car 14 can be slowed as it approaches the first treatment device 170, and proceed slowly or stop adjacent the first treatment device 170 so the card 50 can receive the first treatment.

The car 14 can then accelerate and move rapidly, as appropriate, toward the second treatment device 170. The car 14 can be slowed as it approaches the second treatment device 170, as appropriate, and proceed slowly or stop adjacent the second treatment device 172 so the card 50 can receive the second treatment operation. The car 14 can then accelerate and move rapidly toward the unloading device 144. The car 14 can be slowed as it approaches the unloading device 144, and proceed slowly or stop adjacent the unloading device 144 while the card 50 is removed from the car 14. The car 14 can move toward the loading device 142 and can proceed slowly or stop adjacent the loading device 142 while a card 50 is positioned on the car 14.

Advantageously, when a card 50 is positioned on or removed from a car 14 as the car 14 is moving on the track assembly 12, the speed of the car 14 and the speed of movement of the respective delivery arm (either 148 or 156) of the respective loading device 142 or unloading device 144 can be appropriately controlled. For example, when a card 50 is being positioned on a car 14, the delivery arm 148 of the loading device 142 can be moved at a speed so that there is little or no relative movement between the card 50 and the car 14 as the card 50 is released from the loading device 142 and positioned on the car 14. In a similar manner, when a card 50 is being removed from a car 14, the delivery arm 156 of the unloading device 144 can be moved at a speed so that there is little or no relative movement between the car 14 and the delivery arm 156 as the card 50 is retrieved from the car 14.

Figure 7:
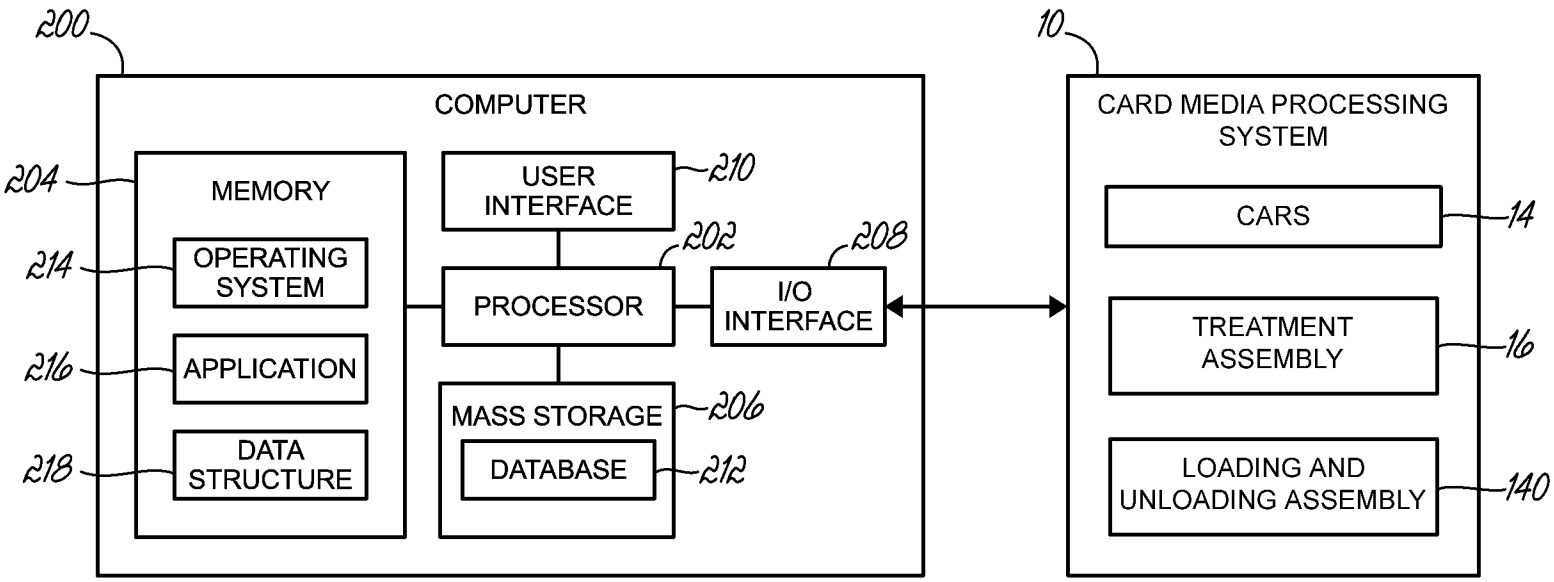
FIG. 7 is a schematic depiction of a computer system for implementing the card media processing system of FIG. 1.

Referring now to FIG. 7, the card media processing system 10 may be implemented on one or more computer devices or systems, such as exemplary computer system 200. The computer system 200 may include a processor 202, a memory 204, a mass storage memory device 206, an input/output (I/O) interface 208, and a user interface 210.

The processor 202 may include one or more devices selected from microprocessors, micro-controllers, digital signal processors, microcomputers, central processing units, field programmable gate arrays, programmable logic devices, state machines, logic circuits, analog circuits, digital circuits, or any other devices that manipulate signals (analog or digital) based on operational instructions that are stored in the memory 204. Memory 204 may include a single memory device or a plurality of memory devices including but not limited to read-only memory (ROM), random access memory (RAM), volatile memory, non-volatile memory, static random access memory (SRAM), dynamic random access memory (DRAM), flash memory, cache memory, or any other device capable of storing information. The mass storage memory device 206 may include data storage devices such as a hard drive, optical drive, tape drive, non-volatile solid state device, or any other device capable of storing information. A database 212 may reside on the mass storage memory device 206, and may be used to collect and organize data used by the various systems and modules described herein.

Processor 202 may operate under the control of an operating system 214 that resides in memory 204. The operating system 214 may manage computer resources so that computer program code embodied as one or more computer software applications, such as application 216 residing in memory 204 may have instructions executed by the processor 202. In an alternative embodiment, the processor 202 may execute the applications 216 directly, in which case the operating system 214 may be omitted. One or more data structures 218 may also reside in memory 204, and may be used by the processor 202, operating system 214, and/or application 216 to store or manipulate data.

The I/O interface 208 may provide a machine interface that operatively couples the processor 202 to other devices and systems of the card media processing system 10, such as the cars 14, the treatment assembly 16, and the loading and unloading assembly 140. The application 216 may thereby work cooperatively with the cars 14, the treatment assembly 16, and the loading and unloading assembly 140 by communicating via the I/O interface 208 to provide the various features, functions, and/or modules comprising embodiments of the invention. The application 216 may also have program code that is executed by one or more external resources, or otherwise rely on functions and/or signals provided by other system or network components external to the computer system 200. Indeed, given the nearly endless hardware and software configurations possible, persons having ordinary skill in the art will understand that embodiments of the invention may include applications that are located externally to the computer system 200, distributed among multiple computers or other external resources, or provided by computing resources (hardware and software) that are provided as a service over a network, such as a cloud computing service.

The user interface 210 may be operatively coupled to the processor 202 of computer system 200 in a known manner to allow a user to interact directly with the computer system 200. The user interface 210 may include video and/or alphanumeric displays, a touch screen, a speaker, and any other suitable audio and visual indicators capable of providing information to the user. The user interface 210 may also include input devices and controls such as an alphanumeric keyboard, a pointing device, keypads, pushbuttons, control knobs, microphones, etc., capable of accepting commands or input from the user and transmitting the entered input to the processor 202.

While the present invention has been illustrated by the description of specific embodiments thereof, and while the embodiments have been described in considerable detail, it is not intended to restrict or in any way limit the scope of the appended claims to such detail. The various features discussed herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of the general inventive concept.

What is claimed is:

1. A card media processing system for treating individual cards, comprising:

a treatment assembly including a treatment device configured for sequentially treating individual cards, a car configured to hold an individual card and to move the card to the treatment device, the car including a card holding member and a vacuum chuck for holding the card in engagement with the card holding member using vacuum pressure, an endless loop track assembly configured to support the car, and a vacuum pressure source and a rotatable hub operatively associated with the vacuum pressure source, the rotatable hub configured to rotate as the car moves along the endless loop track assembly so as to enable the vacuum pressure source to provide vacuum pressure to the vacuum chuck at any location of the car along the endless loop track assembly, wherein the car includes a driven roller configured to engage the endless loop track assembly to move the car therealong, the driven roller being operatively connected with a drive for causing rotation of the driven roller.

2. The card media processing system of claim 1, wherein the endless loop track assembly includes an upper rail surface, an inner rail surface, and an outer rail surface, and the car further includes a pair of guide rollers, and further wherein the driven roller engages the upper rail surface and the pair of guide rollers respectively engage the inner rail surface and the outer rail surface when the car moves along the endless loop track assembly.

3. The card media processing system of claim 1, wherein the card holding member includes a card holding surface configured for receiving the card in a generally horizontal orientation.

4. The card media processing system of claim 1, further comprising a card loading and unloading assembly configured to deliver a card to the car and to remove a card from the car.

5. The card media processing system of claim 4, wherein the card loading and unloading assembly includes a loading device configured for delivering a card to the car and a separate unloading device configured for removing a card from the car.

6. The card media processing system of claim 1, where the treatment device is configured to perform at least one of a printing treatment and a magnetic strip encoding treatment.

7. The card media processing system of claim 1, further comprising a plurality of the cars, each car being configured to be controlled independently of the other cars.

8. The card media processing system of claim 1, wherein the endless loop track assembly has a generally I-shaped profile including a foot, a head, and a web extending between the foot and the head, and further wherein the driven roller engages the head of the profile when the car moves along the endless loop track assembly.

9. The card media processing system of claim 1, wherein the treatment assembly includes a plurality of treatment devices for treating cards.

10. A card media processing system for treating individual cards, comprising:

a treatment assembly including a plurality of treatment devices configured for sequentially treating individual cards, a plurality of cars, each car being configured to hold an individual card and to move the card to and between the plurality of treatment devices, each car including a card holding member and a vacuum chuck for holding the card in engagement with the card holding member using vacuum pressure, an endless loop track assembly configured to support the plurality of cars, a card loading and unloading assembly configured to deliver a card to a car of the plurality of cars and to remove a card from the car, and a vacuum pressure source and a rotatable hub operatively associated with the vacuum pressure source, the rotatable hub configured to rotate as the plurality of cars move along the endless loop track assembly so as to enable the vacuum pressure source to provide vacuum pressure to the vacuum chuck of each car at any location of the car along the endless loop track assembly, each car being configured to be controlled independently of the other cars and including a driven roller configured to engage the endless loop track assembly to move the car therealong, each driven roller being operatively connected with a drive for causing rotation of the driven roller.

11. The card media processing system of claim 10, wherein the endless loop track assembly includes an upper rail surface and the driven roller of each car engages the upper rail surface when the car moves along the endless loop track assembly.

12. The card media processing system of claim 10, wherein the card holding member of each car includes a card holding surface configured for receiving the card in a generally horizontal orientation.

13. The card media processing system of claim 10, wherein the card loading and unloading assembly includes at least one arm having a hand configured to retain the card.

14. A method of treating card media, comprising:

delivering an individual card onto a car having a card holding member, holding the card in engagement with the card holding member using vacuum pressure, operating a drive to move the car along an endless loop track assembly toward a treatment device, providing vacuum pressure to the car with a vacuum source operatively associated with a rotatable hub, the rotatable hub configured to rotate as the car moves along the endless loop track assembly so as to enable the vacuum pressure source to provide the vacuum pressure to the car at any location of the car along the endless loop track assembly, performing a treatment on the card with the treatment device, operating the drive to move the car further along the endless loop track assembly away from the treatment device, and removing the card from the car.

15. The method of claim 14, wherein the car includes a driven roller configured to engage the endless loop track assembly, the driven roller being operatively connected with the drive for causing rotation of the driven roller.

16. The method of claim 14, wherein performing a treatment occurs with the car stopped on the endless loop track assembly.

17. The method of claim 14, wherein performing a treatment occurs with the car moving on the endless loop track assembly.

18. The method of claim 14, wherein at least one of delivering an individual card and removing the card occurs with the car stopped on the endless loop track assembly.

19. The method of claim 14, wherein at least one of delivering an individual card and removing the card occurs with the car moving on the endless loop track assembly.

20. The method of claim 14, wherein at least one of operating the drive to move the car toward the treatment device or operating the drive to move the car away from the treatment device includes controlling a servomotor to accelerate the car along the endless loop track assembly.

* * * * *